US005694031A

United States Patent [19]

Stanojevic

[11] Patent Number: 5,694,031

[45] Date of Patent: Dec. 2, 1997

[54] VOLTAGE REGULATOR WITH DIFFERENTIAL CURRENT STEERING STAGE

[75] Inventor: Silvo Stanojevic, Milpitas, Calif.

[73] Assignee: Exar Corporation, Fremont, Calif.

[21] Appl. No.: 632,977

[22] Filed: Apr. 16, 1996

[51] Int. Cl.[6] ..... G05F 3/16

[52] U.S. Cl. ..... 323/313; 323/314; 323/315

[58] Field of Search ..... 323/313, 312, 323/315, 280, 281

[56] References Cited

U.S. PATENT DOCUMENTS

| | | | |
|---|---|---|---|
| 4,072,870 | 2/1978 | Davis | 307/350 |
| 4,319,179 | 3/1982 | Jett, Jr. | 323/281 |
| 5,453,679 | 9/1995 | Rapp | 323/313 |

*Primary Examiner*—Peter S. Wong

*Assistant Examiner*—Rajnikant B. Patel

*Attorney, Agent, or Firm*—Townsend and Townsend and Crew LLP

[57] ABSTRACT

An improved voltage regulator which can operate in a two-lead environment with a widely varying power supply is provided. The voltage regulator of the invention has an output circuit stage connected between a supply voltage and a reference voltage. A pass transistor, as one leg of a differential current steering stage, provides drive current to the output stage. A bandgap error amplifier is coupled between the reference voltage output and the pass transistor to shunt current from the pass transistor when the reference voltage varies from the desired voltage value.

13 Claims, 2 Drawing Sheets

VOLTAGE REGULATOR WITH DIFFERENTIAL CURRENT STEERING STAGE

BACKGROUND OF THE INVENTION

The present invention relates to voltage regulator circuits, and in particular to voltage regulators for use in a two-lead switch environment.

Voltage regulator circuits are well known for providing a precise voltage reference output. In most environments, the voltage regulator operates off a supply voltage which can vary, and it is the job of the voltage regulator to provide a precise voltage reference output independent of fluctuations in the supply voltage.

In some applications, a voltage regulator may be required where the supply voltage can vary greatly. One such environment is where a switch, such as a proximity switch, must be placed in series with a load. In such a configuration, the only inputs to the proximity switch circuitry, which would include the voltage regulator, are the two leads. The voltage can vary significantly depending upon whether the switch is open or closed. In the open switch configuration, some small trickle current must be made available to power circuitry.

A typical voltage regulator will reference its control circuitry to the supply voltage itself, thus making it susceptible to errors due to wide variations in the supply voltage. Error correction circuitry is also typically connected to the supply voltage, and thus the amount of error correction possible is limited for wide variations in the supply voltage.

It is desirable to have a voltage regulator which can operate in a two-lead environment and provide an accurate reference voltage output in spite of large swings in the supply voltage. Such a circuit must have a high power supply rejection ratio (PSRR).

SUMMARY OF THE INVENTION

The present invention provides an improved voltage regulator which can operate in a two-lead environment with a widely varying power supply. The voltage regulator of the invention has an output circuit stage connected between a supply voltage and a reference voltage. A pass transistor, as one leg of a differential current steering stage, provides drive current to the output stage. A bandgap error amplifier is coupled between the reference voltage output and the pass transistor to shunt current from the pass transistor when the reference voltage varies from the desired voltage value.

In a preferred embodiment, the bandgap error amplifier is coupled between the reference voltage output and a bandgap reference voltage output. A transistor in the bandgap error amplifier couples the reference voltage output to the differential current steering stage. The differential current steering stage has one input driven by the bandgap error amplifier, and the other input is a reference voltage provided by a voltage clamp. The differential current steering stage regulates the current to the output stage.

By connecting the bandgap error amplifier to the reference voltage output, rather than the supply voltage, it is insulated from wide variations in the supply voltage. Similarly, using a transistor in the bandgap regulator which is also connected to the voltage reference output, to drive the error amplifier, isolates the error amplifier from the voltage supply fluctuations. Such a circuit as the present invention thus requires a start-up circuit to provide current to the output stage from the voltage supply until the voltage reference output comes up to a sufficient voltage to power the bandgap regulator.

For a further understanding of the nature and advantages of the invention, reference should be made to the ensuing description taken in conjunction with the accompanying drawings.

DETAILED DESCRIPTION OF THE PREFERRED EMBODIMENTS

Figure 1:
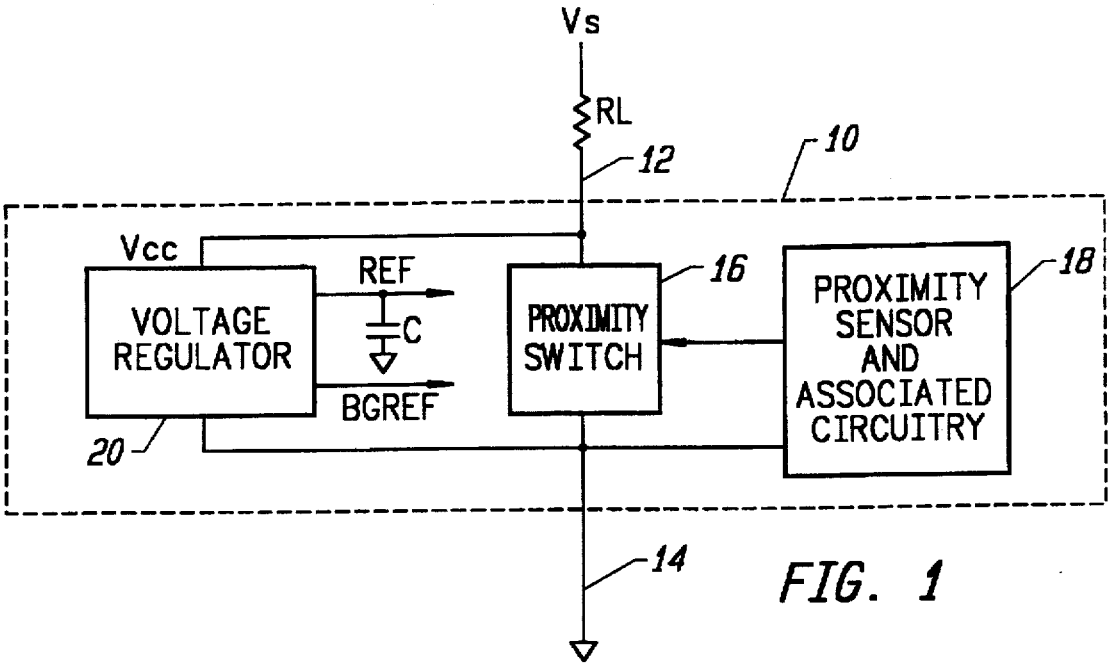
FIG. 1 is a block diagram of a proximity switch circuit into which the present invention could be incorporated.

FIG. 1 is a block diagram of one embodiment of a switching circuit into which the present invention could be incorporated. A switching circuit card 10 is connected between two leads 12 and 14. Lead 12 is connected to the load, $R_L$, and through the load to a voltage supply, $V_S$. Lead 14 is connected to ground.

A proximity switch 16 connects the load to ground, to close the circuit when enabled by a proximity sensor and associated circuitry 18. Both of these circuits need a reference voltage to operate on, typically a voltage reference, REF, and a bandgap voltage reference, BGREF. These are provided by a voltage regulator circuit 20. Voltage regulator 20 receives its power, $V_{cc}$, from the first lead 12, and has its ground connected to the second lead 14. As can be seen, the voltage on lead 12 can vary widely depending upon whether proximity switch 16 is open or closed.

In one embodiment, circuit 10 operates where the supply voltage can vary from 10 volts to 55 volts for the supply voltage. Between the on state and off state of the switch, $V_{CC}$ can vary from 2.5 volts to 55 volts. As can be seen, voltage regulator 20 must thus have a high power supply rejection ratio (PSRR) to operate in such an environment.

Figure 2:
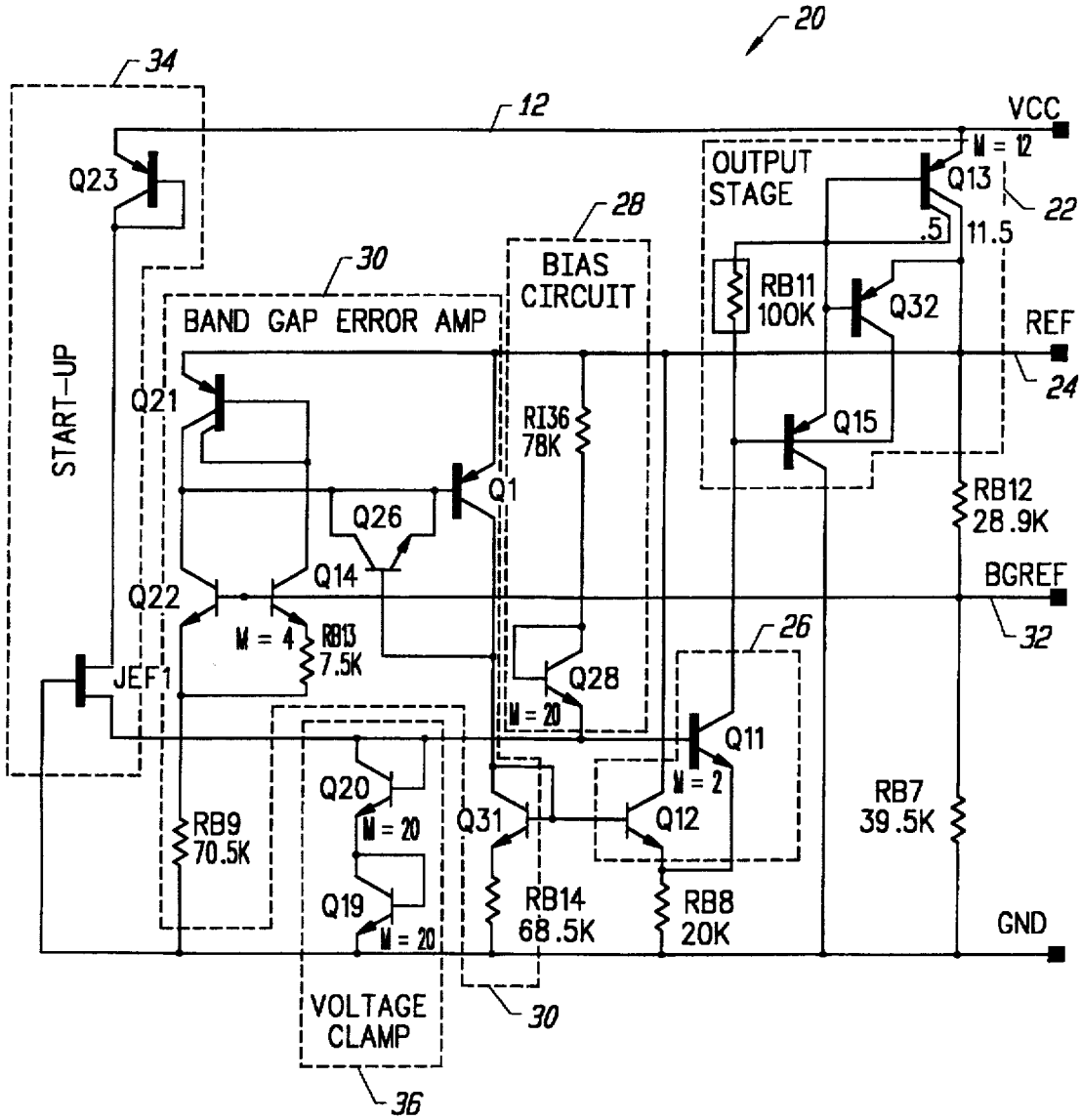
FIG. 2 is a circuit diagram of a voltage regulator according to one embodiment of the present invention.

FIG. 2 is a circuit diagram of one embodiment of a voltage regulator 20 according to the present invention. The regulator includes an output stage 22 which provides the output voltage, REF, on line 24. The output stage is driven by one leg of a differential current steering stage 26, which is stabilized at the appropriate voltage reference output level by a bandgap error amplifier 30. Note that bias circuit 28 is referenced to the voltage reference output, 24, and not the supply voltage, $V_{CC}$, on line 12.

In addition, a bandgap error amplifier 30 provides a bandgap voltage output (BGREF) on a line 32. This voltage is provided at a fixed value by the bandgap error amplifier, and the reference voltage on line 24 is referenced to this voltage by virtue of a resistor divider consisting of resistors RB12 and RB7. Note, again, that bandgap error amplifier 30 is referenced to the voltage reference output line 24, and not to the supply voltage 12.

Since voltage reference output line 24 initially will not have sufficient voltage to power bias circuit 28, a start-up circuit 34 is used to provide enough current to the base of transistor Q11 in differential current steering stage 26 to provide the initial power to bring up the voltage on voltage reference line 24. The voltage provided by this current is limited by a voltage clamp circuit 36.

Regulator 20 includes the differential current steering stage 26, consisting of transistors Q11 and Q12. Again, transistor Q12 has its collector connected to the voltage reference output line 24, not to the supply voltage 12. Shunt current is provided through transistor Q12 to resistor RB8 in the differential current steering stage 26. This essentially shunts, or steals current from the emitter of Q11 to provide feedback to keep the output stage driving the voltage reference at the appropriate voltage.

The differential current steering stage of Q11 and Q12 is in a common-emitter configuration, with Q12 connected to an input of this stage, and Q11 connected to a reference voltage from voltage clamp 36. This stage converts the voltage at Q12 into a current to drive BGREF, which feeds back through bandgap error amplifier 30.

Upon start-up of the circuit, with a voltage supply connection to $V_{CC}$, transistors Q23 and JEF1 provide base drive to transistor Q11. Additional base drive, in the form of positive feedback, appears through bias circuit 28 consisting of resistor RI36 and transistor Q28, configured as a diode. This feedback appears as soon as the reference voltage on line 24 exceeds two VBEs. When this reference voltage reaches 3VBEs, positive feedback gain reduces to a very low value preventing instability due to positive feedback. This positive feedback loop drives the Q11 transistor with its peak output current, with the Q11 transistor in turn driving the output stage 22.

Output stage 22 consists of a PNP Darlington pair of transistors Q15 and Q13. The output transistor Q13 charges a compensation capacitor connected to line 24, shown as capacitor C in FIG. 1. This capacitor is charged to the regulated output voltage level.

A resistive divider circuit consisting of resistors RB12 and RB7 is connected between the reference voltage line 24 and ground, providing feedback to the bandgap reference line 32.

In bandgap error amplifier 30, a transistor Q1 has a collector output which remains off for BGREF voltages below the bandgap voltage value. When the bandgap voltage BGREF reaches its equilibrium value, transistor Q1 turns on, activating the current steering stage.

The input voltage to the current steering stage is generated by the diode-connected transistor Q31 and resistor RB14. As the Q1 collector current increases, the base voltage of Q12 increases, forcing Q12 to conduct, which steals or shunts the base drive from the output stage. The current through Q12 will increase until an equilibrium is reached. At equilibrium, the bandgap reference maintains its design value. In the embodiment shown, the design value is 1.25 volts. At this point, the reference voltage remains in regulation at a level defined by the resistor divider gain multiplied by the bandgap reference voltage. The expression for the regulated voltage is VREF=[(RB12+RB7)/RB7]BGREF.

The differential current steering stage input presents the bandgap error amplifier output with a near constant impedance load. Hence the bandgap AC characteristics remain near constant over the entire reference current load range. The output stage requires an external capacitor with a minimum value of 1 uF to establish a dominant pole in the closed loop. The transistor Q11 is configured in the common base configuration which gives it high output impedance and its BVCER breakdown voltage approaches its collector base breakdown, lending it to 60V operation without going into collector-emitter breakdown, which normally occurs at 40V. To keep Q11 from saturating, in an on state at cold temperatures, the emitter area of the Q19 and Q20 diodes is increased to 10 times that of the Q11 transistor. Thus, the Q11 emitter drops by approximately 100 mV, at −20° C., below the level that it would reside at if there was no difference in the emitter area.

As can be seen, by referencing the bias and bandgap circuits to the voltage reference output, and thus the error amplifier to the voltage reference output, the regulator can provide very high power supply rejection. A circuit constructed as set forth in FIG. 2 has been measured to provide a PSRR in excess of 80 dB. In addition, the voltage reference temperature coefficient was measured below 100 ppm/°C. (ppm=parts per million).

As will be understood by those of skill in the art, the present invention may be embodied in other specific forms without departing from the spirit or essential characteristics thereof. Accordingly, the above embodiment is meant to be illustrative, but not limiting, of the scope of the invention, which is set forth in the following claims.

What is claimed is:

1. A voltage regulator comprising:

an output circuit stage coupled between a supply voltage input and a reference voltage output;

a differential current steering stage coupled to said output circuit stage for providing drive current to said output stage;

a bandgap error amplifier, coupled between said reference voltage output and said differential current steering stage, said differential current steering stage being configured to shunt current from said output circuit stage when said reference voltage varies from a desired voltage value.

2. The voltage regulator of claim 1 further comprising a voltage clamp circuit coupled to said differential current steering stage.

3. The voltage regulator of claim 1 wherein said output circuit stage includes a darlington pair of PNP transistors, said differential current steering stage being coupled to the base of one of said PNP transistors.

4. The voltage regulator of claim 1 wherein said differential current steering stage includes a transistor coupled to said output circuit stage, and a resistor coupled between said transistor and ground.

5. The voltage regulator of claim 4 wherein said bandgap error amplifier is coupled to said resistor.

6. The voltage regulator of claim 1 further comprising a voltage clamp circuit, and wherein said differential current steering stage has a first input coupled to said bandgap error amplifier and a second input coupled to said voltage clamp circuit.

7. The voltage regulator of claim 1 further comprising a start-up circuit coupled between said supply voltage input and said differential current steering stage for providing current to said output circuit stage before said reference voltage output has a predetermined voltage.

8. The voltage regulator of claim 1 further comprising a bias circuit coupled between said reference voltage output and said differential current steering stage.

9. A voltage regulator comprising:

an output circuit stage coupled between a supply voltage input and a reference voltage output;

a differential current steering stage coupled to said output circuit stage for providing drive current to said output stage;

a bandgap error amplifier, coupled between said reference voltage output and said differential current steering stage, said differential current steering stage being configured to shunt current from said output circuit stage when said reference voltage varies from a desired voltage value;

a start-up circuit coupled between said supply voltage input and said differential current steering stage for providing current to said output stage before said reference voltage output has a predetermined voltage; and a bias circuit coupled between said reference voltage output and said differential current steering stage.

10. The voltage regulator of claim 9 wherein said output circuit stage includes a darlington pair of PNP transistors, said differential current steering stage being coupled to the base of one of said PNP transistors.

11. The voltage regulator of claim 9 wherein said differential current steering stage includes a transistor coupled to said output circuit stage, and a resistor coupled between said differential current steering stage and ground.

12. The voltage regulator of claim 11 wherein said differential current steering stage is coupled to said resistor.

13. A voltage regulator comprising:

an output circuit stage coupled between a supply voltage input and a reference voltage output, said output circuit stage including a darlington pair of PNP transistors;

a differential current steering stage coupled to said output circuit stage for providing drive current to said output stage, said differential current steering stage including a transistor coupled to said output circuit stage, and a resistor coupled between said differential current steering stage and ground, said differential current steering stage being coupled to the base of one of said PNP transistors;

a bandgap error amplifier coupled between said reference voltage output and said differential current steering stage, said differential current steering stage being configured to shunt current from said output stage when said reference voltage varies from a desired voltage value;

a start-up circuit coupled between said supply voltage input and said differential current steering stage for providing current to said output stage before said reference voltage output has a predetermined voltage; and a bias circuit coupled between said reference voltage output and said differential current steering stage.

* * * * *